US006018885A

United States Patent [19]

Hill

[11] Patent Number: 6,018,885

[45] Date of Patent: Feb. 1, 2000

[54] FIRE AND RESCUE EQUIPMENT DRYER SYSTEM AND METHOD

[76] Inventor: Frederick J. Hill, 19 Anna La., Sand Lake, N.Y. 12153

[21] Appl. No.: 09/037,073

[22] Filed: Mar. 9, 1998

[51] Int. Cl.[7] ..... F26B 19/00

[52] U.S. Cl. ..... 34/202; 34/224

[58] Field of Search ..... 34/380, 89, 90, 34/103, 603, 604, 607, 138, 170, 192, 194, 202, 204, 218, 224, 237, 239, 240; 312/213, 229, 249.9

[56] References Cited

U.S. PATENT DOCUMENTS

| | | | |
|---|---|---|---|
| 2,091,746 | 8/1937 | Wiley . | |
| 2,561,652 | 7/1951 | Doolan . | |
| 4,257,173 | 3/1981 | Smith . | |
| 5,369,892 | 12/1994 | Dhaemers | 34/275 |
| 5,412,928 | 5/1995 | Reithel . | |
| 5,471,764 | 12/1995 | Krueger . | |
| 5,513,446 | 5/1996 | Neubauer et al. . | |
| 5,546,678 | 8/1996 | Dhaemers | 34/275 |
| 5,555,640 | 9/1996 | Ou . | |
| 5,572,893 | 11/1996 | Goda et al. . | |
| 5,625,960 | 5/1997 | Fujita . | |
| 5,755,040 | 5/1998 | Ou | 34/202 |

*Primary Examiner*—Stephen Gravini
*Attorney, Agent, or Firm*—Schmeiser, Olsen & Watts

[57] ABSTRACT

A drying unit for drying fire and rescue equipment is disclosed. The unit includes a fresh air intake and heating system into which fresh air is drawn and heated. Once the air is heated it is passed into a drying chamber where wet items are placed. As drying occurs, excess moisture is collected in the water removal and exhaust system where it is evaporated by the heated air and then exhausted from the drying unit by an exhaust fan.

13 Claims, 3 Drawing Sheets

FIRE AND RESCUE EQUIPMENT DRYER SYSTEM AND METHOD

FIELD OF THE INVENTION

The present invention relates generally to a drying apparatus. In particular, the present invention is a system and method for drying fire and rescue equipment and turnout gear.

BACKGROUND OF THE INVENTION

Heretofore many drying chambers have existed which dry clothing or the like. However, there exists the need for a drying apparatus or chamber which can dry clothing, equipment, or the like with optimal efficiency and without deteriorating the quality of the items being dried. Moreover, a system is needed which provides for the removal of excess moisture from the chamber without requiring a user to do so manually. Previous devices for drying garments and the like have failed to show these features.

One type of prior model comprises an apparatus specifically designed for drying fire and rescue gear. However, this device is not a closed chamber but rather, is an open-framed device which fails to provide for optimal drying efficiency.

Another example of an existing clothes drying device is a chamber in which wet garments are placed. The garments are dried by air which is heated by electrical heating elements. The heated air is forced through the garments and out an exhaust vent. Such an apparatus fails to provide, however, a device which collects excess water such that any excess water is evaporated by the passing over of heated air.

U.S. Pat. No. 5,555,640 to Ou, hereby incorporated by reference, discloses a closed drying chamber having a fan device which forces heated air through wet garments. The excess moisture from the wet garments is collected at the base of the chamber and is emptied periodically by a user. The Ou device, however, fails to provide a water removal system whereby heated air is drawn through the chamber and the excess water from the garments is evaporated by the heated air without the need for further interaction by a user.

Thus, there exists a need for a drying chamber through which is drawn heated air for the drying of garments, equipment and the like. Furthermore, there exists the need for such an apparatus to account for the collection and evaporation of excess water to increase system efficiency and reduce user interaction.

All of the references cited herein are hereby incorporated by reference.

SUMMARY OF THE INVENTION

The present invention provides a drying apparatus that addresses these problems. This drying apparatus generally includes three main components: 1) a fresh air intake and heating system; 2) the drying chamber; and 3) the water removal and exhaust system.

Air is introduced to the system through the fresh air intake and heating system where it is heated upon passage over heating elements and discharged into the drying chamber. Inside the drying chamber, wet garments, equipment, or the like are placed so that the heated air from the air intake and heating system is circulated therethrough thus, drying the items inside the chamber.

As the excess water drips from the items, it passes through perforations in the floor of the chamber and into a drip-pan. Once collected, the moisture is evaporated as the heated air from the drying chamber is pulled through the floor perforations and passed over the drip pan by an exhaust fan. The air is then exhausted out of the chamber through an outlet port.

BRIEF DESCRIPTION OF THE DRAWINGS

These and other advantages of the present invention will become more apparent upon examination of the drawings wherein.

DETAILED DESCRIPTION OF THE DRAWINGS

Figure 1:
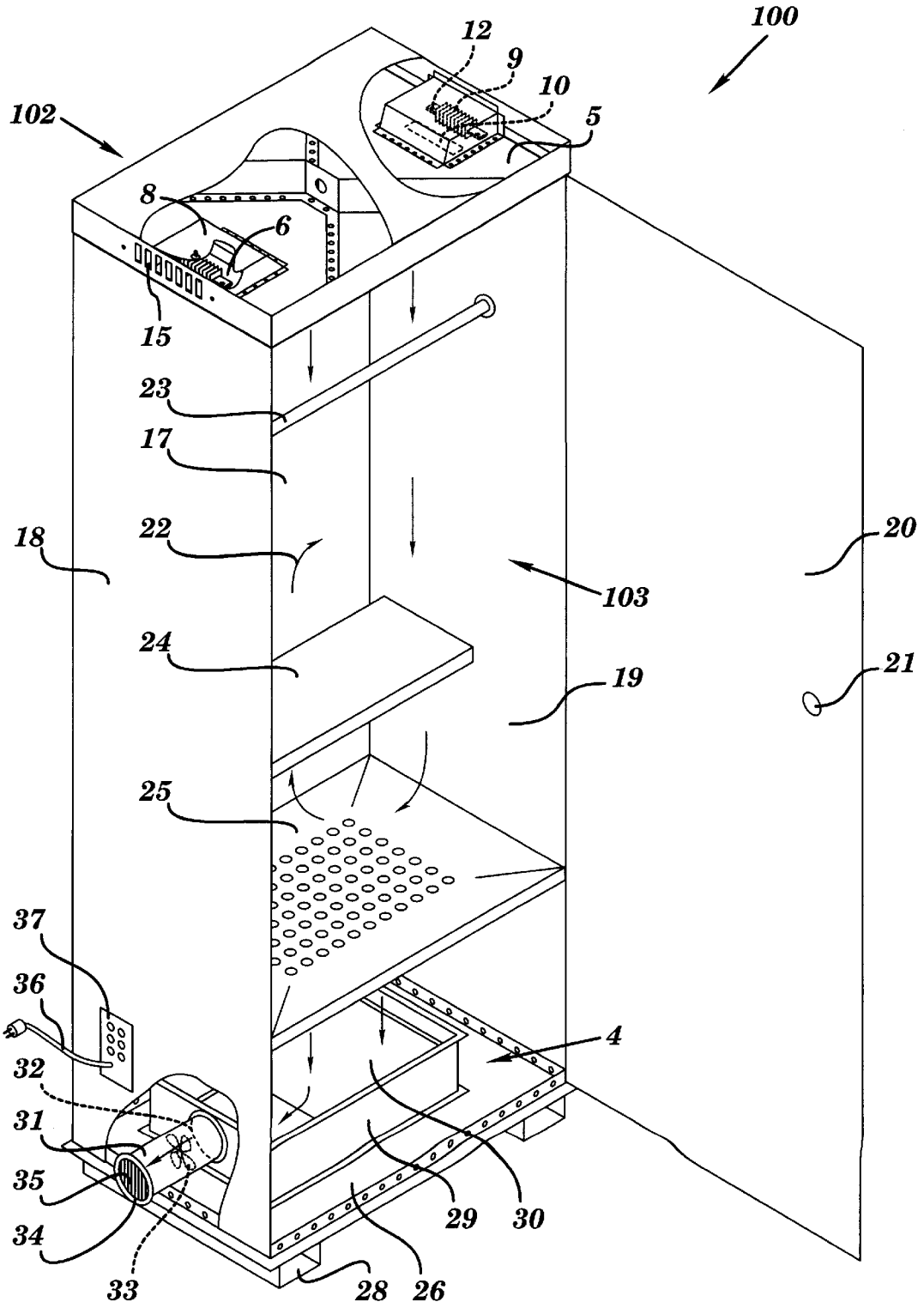
FIG. 1 shows an isometric view of the preferred embodiment of the present invention.
Figure 2:
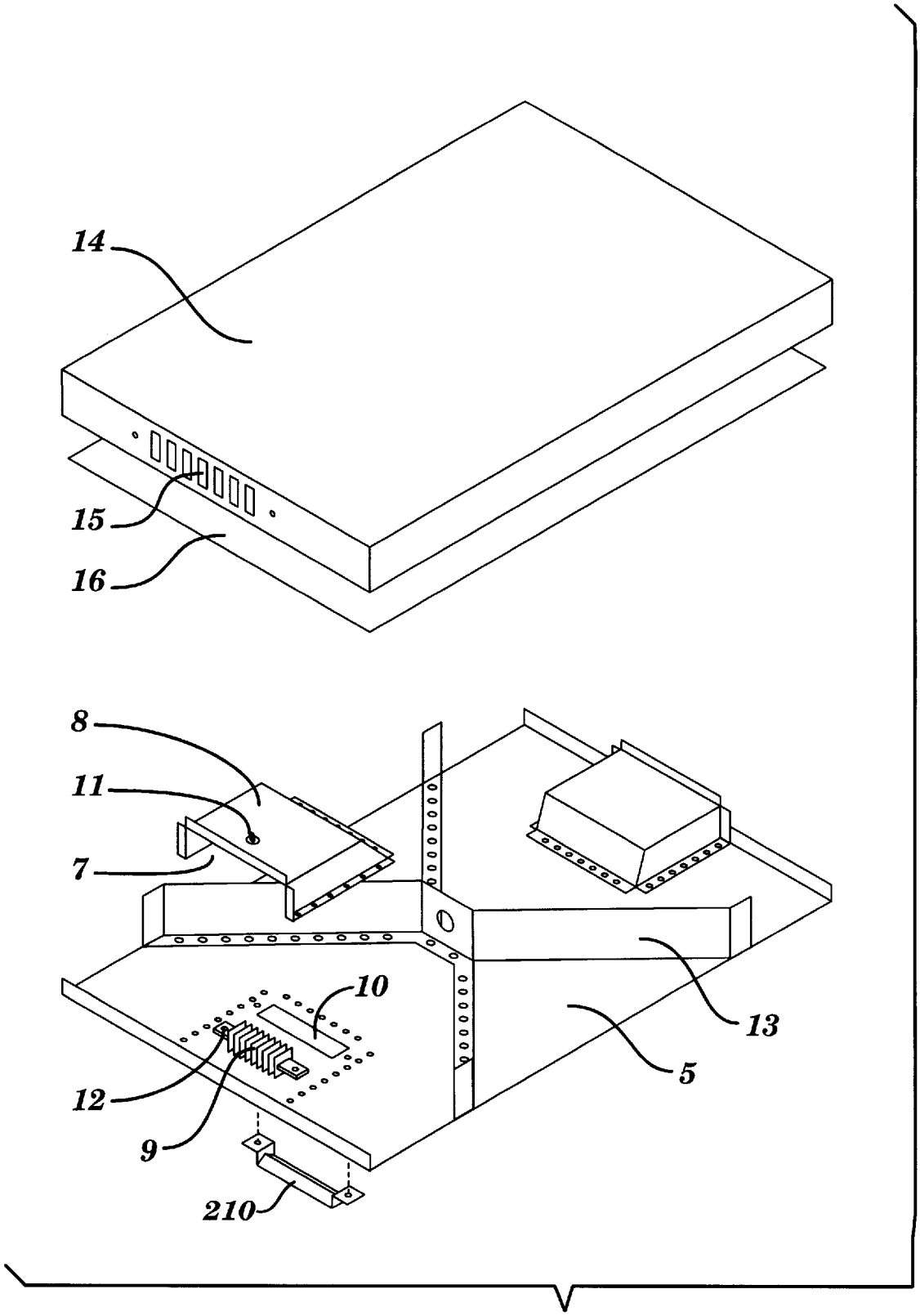
FIG. 2 shows an exploded view of the fresh air intake and heating system of the present invention.

Referring to FIGS. 1 and 2, a drying unit 100 is shown in accordance with the preferred embodiment of the present invention. The unit has three main components: 1) the fresh air intake and heating system 102 (hereinafter "stove"); 2) the drying chamber 103; and 3) the water removal and exhaust system 4.

The stove 102 is positioned above the drying chamber 103 and includes a bottom sheet 5 which also forms the top of the drying chamber 103. Located on opposing sides of the bottom sheet 5 are two fresh air intake chambers 6 into which air from the surrounding environment is drawn. Each air intake chamber includes: air duct 8, heating element 9, and discharge port 10. Each air duct 8 is fastened to the bottom sheet 5 and is configured to be open to air inlet 7 while curving downward over the discharge port 10. Fresh air is drawn into the air inlets 7 by exhaust fan 33 and directed by air ducts 8 over heating elements 9. Upon passage over heating elements 9, the air becomes heated and is then further directed by air duct 8 through the discharge port 10 over a diffuser 210 and into the drying chamber 103. The diffuser provides air mixture for constant temperature to ensure air flow over the entire clothes surface for optimal drying of the clothes. It should be understood that the number, configuration and placement of the air intake chambers may vary. For example, a unit may include more or less that two air intake chambers.

On top of an air duct 8, a high limit switch 11 is positioned so that power to the drying unit may be cut off in the event of equipment failure so that the internal temperature in the drying unit does not damage the items placed therein. It should also be understood that there exists many variations in the number and placement of high limit switch 11.

Each of the heating elements 9 are fixed to the bottom sheet 5 by two studs 12 which are attached to the bottom sheet 5 in between discharge ports 10 and air inlets 8. Attachment of the studs 12 is preferably accomplished by welding but it should be realized that many means of attaching the studs 12 exist including, inter alia, bolts, screws, rivets and/or welding. The stove 102 is also provided with an X-shaped vertical stiffener 13 which separates the air intake chambers and provides support for the stove 102. Included in the stiffener is an opening (not shown) which permits the passage of wiring between components. It should be noted, however, that the configuration and placement of the stiffener may vary.

A top 14 is provided which covers the stove 102. The top 14 includes slots 15 on each opposing end (only the slots on one end are shown) which cover the air inlets 7 of air intake chambers 6 so that the top 14 will not impede the flow of fresh air into the drying unit 100. Between the top 8 and stove 102 a layer of insulation 16 may be provided so that the drying unit 100 may retain the heat generated by the heating elements 9. Such insulation may also be provided within the panels of drying chamber 103. Although there are many types of insulation which suit the present invention, the preferred embodiment utilizes fiber glass insulation. After the insulation is in place, the top 14 fits over and around the stove 102 and is attached into the bottom sheet 5. Attachment of the top 14 is preferably accomplished by screws, bolts or other similar means, but it should be realized that many means for attaching exist. Moreover, it should be realized that the configuration of the top 14 may vary as well.

The drying chamber 103 is operatively attached below the stove 102 and is formed with rear panel 17, left side panel 18, right side panel 19 and door 20. Each panel is fastened to the bottom sheet 5 thus, ensuring stability of the drying unit 100. The door 20, may be provided with a latch, knob or other similar closing means 21 so as to facilitate opening and closing of the unit 100. Although four panels have been herein described, it should be realized that the configuration of the drying chamber, including its affixation to the bottom sheet 5, may vary.

Heated air is drawn into and through the chamber 103 from discharge ports 10 in the directions generally shown by air current arrows 22, created by exhaust fan 33. Inside the chamber 103, wet clothes, equipment or the like may be hung on hanging pole 23 or placed on shelf 24. It should be realized, however, that the number and placement of hanging poles and shelves may vary. While in the chamber 103, the heated air will circulate through and around the moisture laden items causing the items to dry while excess moisture drops to the bottom of the drying chamber. The chamber floor 25, is sloping downwards toward the center and has perforations 205 therein so that excess moisture will pass through the floor 25 to the below water removal and exhaust system 4.

Figure 3:
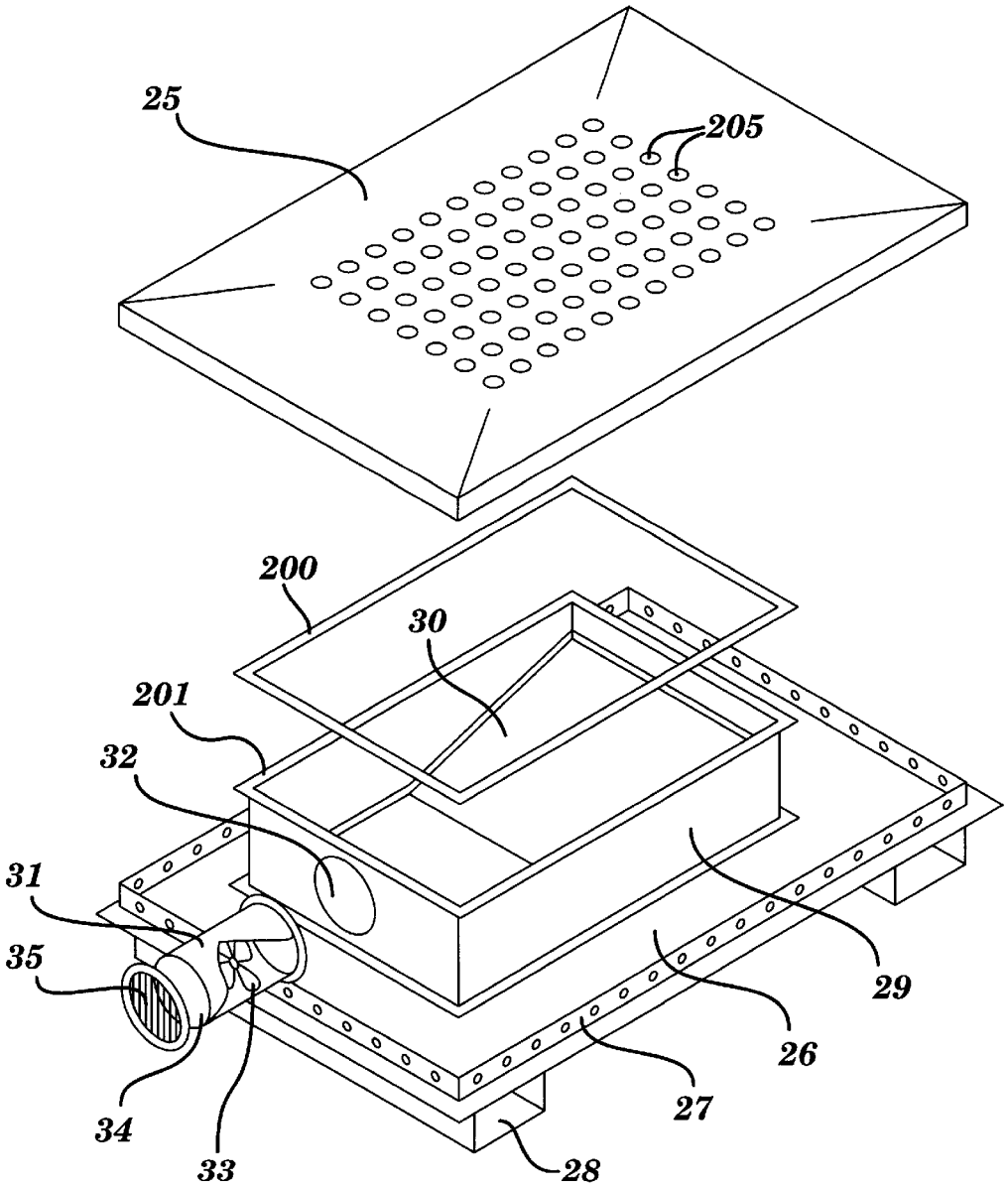
FIG. 3 shows an exploded view of the water removal and exhaust system of the present invention.

Referring to FIG. 3, the water removal and exhaust system 4 is below the drying chamber 103 and serves both as a vehicle for the removal of excess water from the drying unit 100 and as an exhaust for the heated air after it has passed through the wet items placed in the drying chamber 103. This system 4 includes a base 26 having a flange 27 mounted around its perimeter. The flange may be attached a variety of ways, but is welded in the preferred embodiment of the present invention. The flange 27 fits inside of the panels 17, 18, 19 of the drying chamber 103 and is fixedly attached thereto. Such attachment is preferably achieved by screws or bolts, but may also be accomplished in a variety of ways. (E.g., welding, riveting.) Attached to the underside of the base 26, are legs 28 which elevate, support and stabilize the drying unit 100. Although FIG. 1 shows two legs 28, it should be realized that the number and arrangement of such legs may vary.

Affixed to the top surface of the base 26 is an airtight plenum 29. Although plenum 29 may be of varying dimensions, the preferred embodiment includes a plenum which is approximately eight (8) inches in depth by fourteen (14) inches wide by twenty-two (22) inches in length. The plenum 29 provides additional support to base 26 while collecting excess water from drying chamber 103. Additionally, plenum 29 provides a duct in which the air from the drying chamber 103 is drawn to exhaust assembly 31 by exhaust fan 33. The placement of exhaust fan 33 in the exhaust assembly is critical because it allows for air and moisture to be pulled from the wet items placed within drying chamber and through the water removal and exhaust system thus, increasing the efficiency of the drying unit. Inside of the plenum 29 is a removable drip pan/air baffle 30 which captures the excess moisture from drying chamber 103. The drip pan 30 is sloped downwards toward exhaust assembly 31 such that heated air from the drying chamber 103 will pass over a substantial portion of the drip pan 30 thus, evaporating the moisture contained therein. As shown in FIGS. 1 and 3, it can be seen that the floor 25 of the drying chamber 103 is also the cover for the water removal and exhaust system. A gasket 200 is positioned between the floor 25 and the plenum 29 for providing an air tight seal. This is important for providing a vacuum effect through the floor 25. The floor 25 includes perforations 205 for drawing air into the plenum. With such a feature the barriers through which moisture and heated air from the drying chamber must travel are reduced, thus improving the overall efficiency of the system. Although the present invention discloses a drip pan 30 within the plenum 29 it should be understood that this arrangement may vary. For example, the drying chamber may be constructed without a plenum.

As depicted in FIGS. 1 and 2, plenum 29 includes a bore 32 such that exhaust assembly 31 may be inserted therein. As heated air is drawn from drying chamber 103 and passes over a substantial portion of drip pan 30, the moisture contained in drip pan 30 is evaporated. This feature reduces the necessary user interaction because the drip need not be emptied manually. Exhaust fan 33, then draws the heated air through exhaust assembly 31 and then forces it through outlet port 34 and grille 35. It is understood, however, that the specific configuration and dimensions of the water removal and exhaust system may vary.

On an outside surface of drying unit 100, an external power cord 36 is attached to control panel 37. The control panel 37, allows a user to set the desired variables of the drying cycle including, inter alia, time of cycle and temperature. It should be realized, however, that there exists many variations in the placement, configuration and function of control panel 37 and power cord 36.

The foregoing description of the preferred embodiment of this invention has been presented for purposes of illustration and description. It is not intended to be exhaustive or to limit the invention to the precise form disclosed, and obviously many modifications and variations are possible in light of the above teaching. Such modifications and variations that may be apparent to a person skilled in the art intended to be included within the scope of this invention as defined by the accompanying claims.

I claim:

1. An apparatus comprising:

a drying chamber;

a system for providing heated air to the drying chamber; and an exhaust system including a device which draws the heated air, and a device for collecting moisture from the drying chamber, wherein the air drawing device draws heated air through the drying chamber, over a substantial portion of the moisture collecting device, and through an outlet port.

2. The apparatus of claim 1, wherein the drying chamber includes a sloped floor having perforations therein.

3. The apparatus of claim 1, wherein the drying chamber includes at least one shelf for placing garments thereon.

4. The apparatus of claim 1, wherein the drying chamber includes at least one hanging pole for hanging garments therefrom.

5. The apparatus of claim 1, wherein the device which draws the heated air is an exhaust fan.

6. The apparatus of claim 1, wherein the system for providing heated air comprises at least one air intake chamber.

7. The apparatus of claim 6, wherein each air intake chamber comprises:

an air inlet;

a heating element; and a discharge port.

8. The apparatus of claim 7, further comprising means for covering the air inlet, heating element, and discharge port.

9. A apparatus comprising:

an air intake chamber including an air inlet, a heating element and a discharge port;

a drying chamber operatively connected to the air intake chamber; and an exhaust system operatively connected to the drying chamber, wherein the exhaust system includes an outlet port, a device for drawing air, and a system for collecting moisture having an exhaust assembly attached thereto, whereby air is drawn into the air inlet, heated by the heating elements, discharged through the discharge port into the drying chamber, and exhausted through the outlet port.

10. The apparatus of claim 9 further comprising a plurality of the air intake chambers.

11. The apparatus of claim 9, wherein the exhaust system further includes a grille, wherein the grille is attachable to the outlet port.

12. An apparatus comprising:

an air intake and heating system;

a drying chamber having a floor, wherein the drying chamber is operatively connected to the air intake and heating system; and an exhaust system, having a device that draws air, operatively attached to the drying chamber, wherein the exhaust system includes a cover which is also the floor to the drying chamber.

13. The apparatus of claim 12, wherein the device that draws the air is an exhaust fan.

* * * * *